US007121215B2

(12) United States Patent
Besnard

(10) Patent No.: US 7,121,215 B2
(45) Date of Patent: Oct. 17, 2006

(54) SECURITY DEVICE FOR TRANSPORTING AND/OR STORING PAPER ITEMS OF VALUE

(75) Inventor: Philippe Besnard, Griselles (FR)

(73) Assignee: Brink's France, Paris (FR)

( * ) Notice: Subject to any disclaimer, the term of this patent is extended or adjusted under 35 U.S.C. 154(b) by 0 days.

(21) Appl. No.: 10/482,705

(22) PCT Filed: Jul. 3, 2002

(86) PCT No.: PCT/FR02/02326

§ 371 (c)(1),
(2), (4) Date: Jun. 15, 2004

(87) PCT Pub. No.: WO03/004818

PCT Pub. Date: Jan. 16, 2003

(65) Prior Publication Data

US 2004/0216651 A1 Nov. 4, 2004

(30) Foreign Application Priority Data

Jul. 3, 2001 (FR) ..... 01 08826

(51) Int. Cl.
*E05G 1/00* (2006.01)

(52) U.S. Cl. ..... 109/25; 109/29

(58) Field of Classification Search ..... 109/25, 109/29

See application file for complete search history.

(56) References Cited

U.S. PATENT DOCUMENTS

| | | | | |
|---|---|---|---|---|
| 2,384,826 A | | 9/1945 | Ferguson | 109/25 |
| 3,559,593 A | * | 2/1971 | Munton et al. | 109/25 |
| 3,851,602 A | | 12/1974 | Lamping | 109/25 |
| 4,099,183 A | * | 7/1978 | Wolff | 342/5 |
| 4,273,478 A | * | 6/1981 | Cedergren | 406/189 |
| 4,363,279 A | * | 12/1982 | Johansson | 109/29 |
| 4,391,203 A | * | 7/1983 | Millar | 109/25 |
| 4,607,579 A | * | 8/1986 | Stenild | 109/25 |
| 4,712,489 A | | 12/1987 | Levavasseur | 109/25 |
| 4,799,435 A | * | 1/1989 | Boutroy | 109/25 |
| 4,852,502 A | * | 8/1989 | Klingberg et al. | 109/25 |
| 5,196,828 A | * | 3/1993 | Keniston | 340/568.7 |
| 5,213,648 A | * | 5/1993 | Vermeulen et al. | 156/307.5 |
| 5,261,954 A | * | 11/1993 | Collings | 106/31.17 |
| 5,406,896 A | * | 4/1995 | Jacobson | 109/29 |
| 5,485,143 A | * | 1/1996 | Keniston | 340/568.7 |
| 5,617,799 A | * | 4/1997 | Kaczorowski | 109/29 |
| 5,732,638 A | * | 3/1998 | Van Lint | 109/29 |
| 5,770,107 A | * | 6/1998 | Hassall et al. | 252/299.6 |
| 6,065,408 A | * | 5/2000 | Tillim et al. | 109/25 |

(Continued)

FOREIGN PATENT DOCUMENTS

FR 2 764 628 12/1998

OTHER PUBLICATIONS

MSDS Material Saftey Data Sheet, "Periodic Acid", Hazards Identification and definitions, p. 1-2, ("oxidizer", "corrosive").*

(Continued)

*Primary Examiner*—Suzanne Dino Barrett
(74) *Attorney, Agent, or Firm*—Young & Thompson

(57) ABSTRACT

A security device for transporting and/or storing paper items of value includes an enclosed area (1) for receiving the items of value. The enclosed area is associated with at least one reservoir (3) for an irreversible paper destruction product (4) which can be dispersed on the items of value (2), controlled by a control device (5).

10 Claims, 1 Drawing Sheet

U.S. PATENT DOCUMENTS

| | | | | |
|---|---|---|---|---|
| 6,292,101 | B1 * | 9/2001 | Stoltz et al. | 340/572.8 |
| 6,527,907 | B1 * | 3/2003 | Pinchen et al. | 156/324 |
| 6,536,348 | B1 * | 3/2003 | Gral | 102/293 |
| 6,564,726 | B1 * | 5/2003 | Lindskog | 109/25 |
| 6,568,336 | B1 * | 5/2003 | Van Lint | 109/29 |
| 2001/0000741 | A1 * | 5/2001 | Pinchen et al. | 428/343 |
| 2001/0002297 | A1 * | 5/2001 | Schweizer et al. | 428/702 |
| 2002/0029728 | A1 * | 3/2002 | Walker | 109/25 |
| 2002/0051861 | A1 * | 5/2002 | Jennings | 428/67 |
| 2003/0194578 | A1 * | 10/2003 | Tam et al. | 428/690 |
| 2004/0023008 | A1 * | 2/2004 | Rosset | 428/195.1 |
| 2004/0154500 | A1 * | 8/2004 | Richard et al. | 109/25 |
| 2004/0202813 | A1 * | 10/2004 | Elguezabal et al. | 428/40.1 |

OTHER PUBLICATIONS

The 1911 Encyclopedia-Love to Know, Article on Sulphuric Acid, p. 3 ("oxidizing agent").*

* cited by examiner

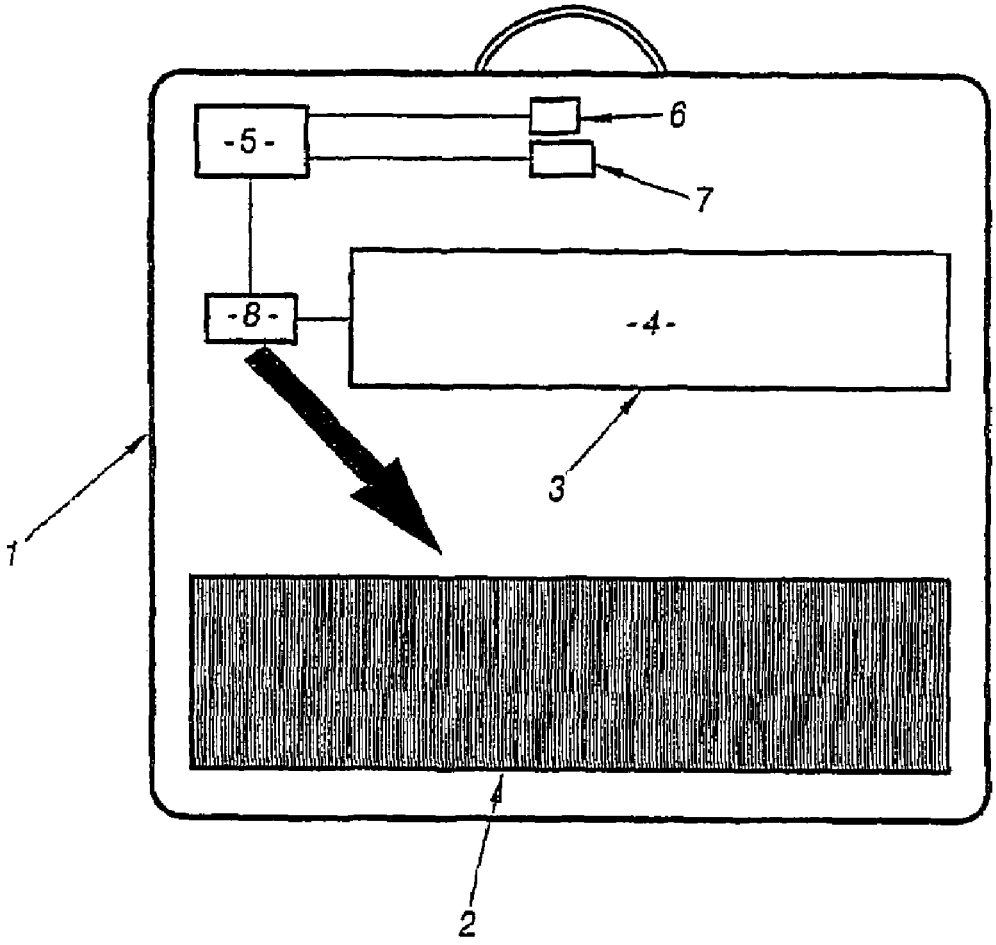
-5-
6
7
-8-
-4-
3
1
2

SECURITY DEVICE FOR TRANSPORTING AND/OR STORING PAPER ITEMS OF VALUE

BACKGROUND OF THE INVENTION

The present invention relates to a security device for transporting and/or storing paper items of value.

DESCRIPTION OF THE RELATED ART

It is known that the transport and/or storage of such items of value is(are) currently effected by using enclosures for receiving the items of value, it being possible for these enclosures to be formed, for example, by boxes, armoured cabinets or also secured cases, etc. . . .

Despite all the precautions taken, for some time now a fresh upsurge has been witnessed in attacks against, for example, the transport vehicles used and against their crews.

It has therefore been decided to associate with the enclosures for receiving items of value, reservoirs of staining product which is suitable for being dispersed on the items of value in the enclosures and the functioning of which is controlled by control means.

Various types of control means have been developed, for example, remote-control means or control means activated by operators of a vehicle.

These staining products are formed by inks or pigments which are in theory intended to render the items of value unusable. However, there is no way of guaranteeing that products for washing and chemically treating the items of value thus stained have not been or will not be discovered, which would then enable, for example, criminals to wash and treat the items of value in order to bring them back into circulation.

It is known, for example, that several new chemical products are developed every day and that it is impossible to test all these products and their combinations to determine whether the inks and pigments used are really reliable.

By way of example, it is known that dimethylformamide, hydrochloric acid, hydrogen peroxide, oxalic acid and Javel water, like other products, are very readily available on the market and can be used to wash, for example, banknotes and restore the appearance they had prior to staining so that they can be recycled.

It will therefore be appreciated that the protection of paper items of value by staining is not completely reliable and no longer acts as a deterrent.

The object of the invention is therefore to solve those problems.

To that end, the invention relates to a security device for transporting and/or storing paper items of value, of the type comprising an enclosure for receiving those items of value, characterised in that the enclosure is associated with at least one reservoir of product for the irreversible destruction of paper, which product is suitable for being dispersed on the items of value under the control of control means.

BRIEF DESCRIPTION OF THE DRAWINGS

The invention will be better understood on reading the following description which is given purely by way of example and with reference to the appended drawing which represents a block diagram illustrating the general structure of a device according to the invention.

A security device for transporting and/or storing paper items of value has been shown in this FIGURE.

DESCRIPTION OF THE PREFERRED EMBODIMENTS

The device comprises an enclosure for receiving the items of value, the enclosure being marked by the general reference 1 and being, for example, in the form of a secured case, the items of value for their part being marked by the general reference 2 and being, for example, in the form of banknotes or the like, such as, for example, title deeds, contracts, etc. . . .

The enclosure is associated with at least one reservoir 3 of product 4 for the irreversible destruction of paper, which product is suitable for being dispersed on the items of value under the control of control means marked by the general reference 5.

The control means are connected to means for detecting a triggering event, such as, for example, a contact 6 for detecting the unauthorised opening of the case or means 7 for checking the integrity thereof, in order, in the case of an attempt at break-in, to enable the control means 5 to trigger the operation of means 8 for dispersing the destruction product on the items of value.

These dispersion means comprise, for example, a pyrotechnic trigger associated with the reservoir, in a conventional manner.

Consideration may of course be given to other control means, such as, for example, means for detecting whether or not a security signal has been received, as known.

The enclosure may also be formed by a box, an armoured cabinet, etc., located in a vehicle, a building, etc.

Paper items of value, such as, for example, banknotes, are constituted by paper, the basic, and almost unique, element of which is cellulose.

The destruction of cellulose by breaking the bonds between the macromolecules thereof enables cellobiose to be obtained.

In the case of banknotes, substrates, such as gelatin and printing inks, are fixed to the cellulose by electronic bonds. The destruction of the macromolecules and their conversion into cellobiose also destroys the electronic bonds to the substrates (inks and gelatin). Those substrates are therefore diluted and mixed in the destruction product. The destruction process is therefore irreversible.

The destruction of paper can be effected more or less rapidly by means of several chemical products. In the case of the destruction of banknotes, or other documents, it is preferable to use methods that are rapid and compatible with the action time of the criminals during an attack, that is to say, from a few seconds to a few minutes. This more or less rapid destruction of the paper, and therefore of the banknotes or the like, may, for example, be achieved by using strong mineral acids and preferably strong oxidising acids. Such acids are, for example, sulphuric acid, nitric acid, perchloric acid, perbromic acid or periodic acid.

It is also possible to use additional oxidising products. Such oxidising products may be, for example, sulphur dioxide, nitric oxide, ozone and potassium chloride and permanganate.

This list of products for destroying the cellulose of banknotes, or other documents, is not restrictive and not exhaustive. In addition, combinations of these products may be considered.

However, some of these acids may pose safety problems for the personnel handling the device. According to one particularly preferred embodiment, the destruction product comprises periodic acid.

Preferably, the periodic acid is associated with another acid, preferably a strong acid. According to another preferred embodiment, the destruction product comprises periodic acid and sulphuric acid. A formulation of the destruction product that has proved particularly suitable comprises from 70 to 90%, in particular approximately 80% by weight of 96% sulphuric acid and from 10 to 30, in particular approximately 20% by weight of periodic acid and from 0 to 20% by weight of water. Such a formulation destroys banknotes within a time lapse of the order of one minute.

This or these product(s) can be stored under pressure or not in one or more reservoirs associated with the enclosure.

The device according to the invention is therefore based on the irreversible destruction of items of value by dispersing thereon a chemical product for destroying paper.

The device according to the invention is suitable for any document on a paper support, such as contracts or bank documents.

The destruction product may also be associated in the reservoir with a staining product of the conventional type, such as ink or pigments.

The invention claimed is:

1. Security device for transporting and/or storing paper items of value and comprising a cellulose with a gelatin and printing ink substrate, of the type comprising an enclosure (1) for receiving those items of value, characterised in that the enclosure is associated with at least one reservoir (3) of product (4) for the irreversible destruction of paper, which product (4) is suitable for being dispersed on the items of value (2) under the control of control means (5), and the product (4) is of an oxidant type, wherein the product (4) comprises periodic acid and upon dispersal of the product onto the received paper items, the received paper items, comprising a cellulose with a gelatin and printing ink substrate, are destroyed within a time lapse in the order of one minute, wherein the destruction product comprises from 70 to 90% by weight of 96% sulphuric acid and from 10 to 30% by weight of periodic acid and from 0 to 20% by weight of water.

2. Device according to claim 1, characterised in that the control means (5) are suitable for triggering the operation of a pyrotechnic trigger (8) for dispersing the product on the items of value, which trigger (8) is associated with the reservoir (3).

3. Device according to claim 1, characterised in that the reservoir (3) of destruction product also contains a staining product.

4. Device according to claim 3, characterised in that the staining product is an ink or a pigment.

5. Device according to claim 1, wherein the destruction product comprises sulphuric acid.

6. Security device for transporting paper items of value, comprising:

an enclosure (1) for receiving paper items of value;

at least one reservoir (3) containing a destruction product comprising an oxidant (4) for the irreversible destruction of paper, the destruction product being in controlled communication with the enclosure for dispersal onto the received paper items; and a control means (5) for controlling the dispersal of the destruction product into the enclosure and onto the received paper items, wherein the product (4) comprises periodic acid and upon dispersal of the product onto the received paper items, the received paper items are destroyed within a time lapse in the order of one minute, and wherein the destruction product comprises from 70 to 90% by weight of 96% sulphuric acid and from 10 to 30% by weight of periodic acid and from 0 to 20% by weight of water.

7. Device according to claim 6, wherein the control means (5) comprises a pyrotechnic trigger (8).

8. Device according to claim 7, wherein the destruction product further comprises a staining product.

9. Device according to claim 8, wherein the staining product is one of an ink and a pigment.

10. Security device for transporting paper items, comprising:

an enclosure (1) for receiving paper items comprising a cellulose with a gelatin and printing ink substrate;

at least one reservoir (3) containing a destruction product comprising for the irreversible destruction of paper, the destruction product being in controlled communication with the enclosure for dispersal onto the received paper items; and a control means (5) for controlling the dispersal of the destruction product into the enclosure and onto the received paper items such that the received paper items are destroyed within a time lapse in the order of one minute, wherein the destruction product comprises approximately 80% by weight of 96% sulphuric acid and from 10to 30% by weight of periodic acid and from 0 to 20% by weight of water.

* * * * *